United States Patent [19]

Nan Chang

[11] Patent Number: 4,602,186

[45] Date of Patent: Jul. 22, 1986

[54] INSULATING MOUNT FOR A CRT EINZEL LENS FOCUS MASK

[75] Inventor: Kern K. Nan Chang, Princeton, N.J.

[73] Assignee: RCA Corporation, Princeton, N.J.

[21] Appl. No.: 641,697

[22] Filed: Aug. 17, 1984

[51] Int. Cl.[4] ..... H01J 29/07

[52] U.S. Cl. ..... 313/407; 313/402

[58] Field of Search ..... 313/402, 404, 407, 477 R, 313/477 HC

[56] References Cited

U.S. PATENT DOCUMENTS 2,824,988 2/1958 Cone ..... 313/477 X 3,421,048 1/1969 Christensen ..... 315/31

*Primary Examiner*—David K. Moore

*Assistant Examiner*—K. Wieder

*Attorney, Agent, or Firm*—E. M. Whitacre; D. H. Irlbeck; T. H. Magee

[57] ABSTRACT

A CRT has an Einzel lens focus mask with a high voltage between the shadow mask and the meshes to achieve a strong focusing action and therefore minimize beam current interception by the shadow mask. The mask is supported by an insulating block inside a tube. During gettering, the getter material does not deposit on the inside of the tube and therefore spurious conduction paths are avoided. Thus the support can withstand the high voltage. A lead-in wire for the mask has a tube surrounding it which is open near the mask. This also withstands the high voltage.

7 Claims, 3 Drawing Figures

INSULATING MOUNT FOR A CRT EINZEL LENS FOCUS MASK

The present invention relates to a CRT (cathode ray tube), and more particularly to a CRT having an Einzel lens focus mask.

A conventional CRT has a color selection electrode or shadow mask, having a plurality of circular or slot-shaped apertures, positioned in spaced relationship to a cathodoluminescent screen. However, the small dimensions of the apertures allow only about 15 percent of an electron beam to pass through the apertures towards the CRT screen, thereby limiting brightness of the displayed image. Also during production of the CRT, a getter material, such as barium, is flashed by means of R.F. induction heating in order to form an inside coating that absorbs residual gases left in the CRT after a vacuum pump-down operation during fabrication.

U.S. Pat. No. 3,421,048 shows a method of achieving less beam current interception by the shadow mask and therefore a higher beam current incident upon the screen. In particular, an "Einzel lens" is used, i.e. additional mesh electrodes are disposed on either side of the shadow mask. The mesh electrodes have the ultor or screen voltage, e.g. 25 KV, applied thereto, while the mask has a lower applied voltage. This causes an electrostatic focusing action that reduces beam current interception by the shadow mask. In particular, said patent discloses that the shadow mask has a potential of 21.8 KV. It has been found by the present inventor that the shadow mask should have, at most, 2000 volts applied to it to increase the focusing effect, and therefore further reduce beam current interception. This also causes the shadow mask to be at the same or an only slightly higher voltage than the cathode of the electron gun to still further minimize current interception by the mask. Lower mask current interception reduces secondary electron emission from the mask. Since the secondary electrons are collected by the mesh, the minimization thereof reduces heating and therefore warping of the mesh. Further, the current requirement of the high voltage ultor power supply is also reduced.

However, a large voltage difference between the shadow mask and the meshes is now present. In turn, this results in voltage breakdown along the support structure for the meshes and the shadow mask due to the getter coating, which is metallic and therefore conducting.

The present invention overcomes the above problem.

SUMMARY OF THE INVENTION

A cathode ray tube comprises an evacuated envelope enclosing a cathodoluminescent screen at one end and an electron gun at an opposing end. A color selection electrode is disposed proximate the screen and has a relatively low voltage applied thereto to reduce electron beam interception. A pair of focusing meshes are disposed on a support frame on either side of the color selection electrode and have a relatively high voltage applied thereto for good focusing action. Support means are used for supporting the color selection electrode relative to the frame. The support means includes an insulating support element having an interior surface, and an inside support for mounting the color selection electrode to the interior surface. A lead-in wire is coupled to the color selection electrode and extends outside the cathode ray tube. An insulating tube is disposed around the lead-in wire and has an open end proximate the color selection electrode and a closed end abutting the envelope. The interior surfaces of the insulating tube and the insulating support element pick up only a very minimal amount of getter material when a getter is flashed, thus preventing voltage breakdown.

DETAILED DESCRIPTION

Figure 1:
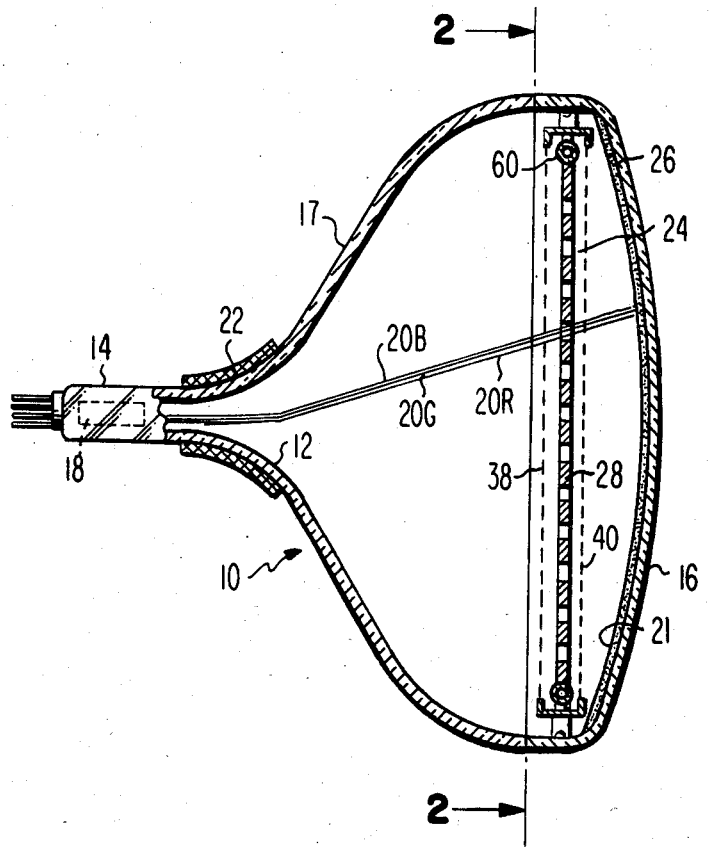
FIG. 1 is a cross-sectional side view of a CRT.

FIG. 1 shows a CRT 10 comprising an evacuated glass envelope 12 having a neck 14 and a faceplate panel 16 connected by a funnel 17. Within the neck 14 is an electron gun 18 that generates three electron beams 20B, 20G, and 20R for exciting blue, green, and red color emitting phosphors, respectively, of a cathodoluminescent screen 21. The landing position of the beams 20 is controlled by deflection coils 22 having currents determined by deflection circuits (not shown). Portions of the beams 20 pass through apertures in a focus mask 24 (described below) to strike a phosphor layer 26 of the screen 21 on the inside of the panel 16.

In particular, the focus mask 24 comprises course focusing meshes 38 and 40 placed on either side of a color selection electrode 28 to form an Einzel lens focus mask. The color selection electrode 28 has circular or slot-shaped apertures (not shown) of conventional size, e.g. 7 mils slot width for a conventional picture or smaller for a high-definition picture. The apertures have bevel-shaped cross-sections due to their being formed by etching from one side. Preferably the wide side of the bevel faces the gun 18 in order to allow a large percentage of electrons in the beams 20 to enter the apertures. The focusing effect of an Einzel lens concentrates the electrons towards the center of the apertures so they exit from the narrow side of the apertures and go to the layer 26. The openings of each of the meshes 38 and 40 comprise 80 percent of the area of the entire mesh, have the same period as the color selection electrode apertures, and are formed by etching. During fabrication, each mesh is pressed into a desired shape, and then is mounted onto a frame means 30 (shown in FIGS. 2 and 3) with the color selection electrode 28. The meshes 38 and 40 are spaced from the color selection electrode $28\frac{1}{4}$ to $\frac{1}{2}$ inch (6.35 to 12.7 mm). The large openings in the meshes 38 and 40 and the large spacing from the color selection electrode 28 makes accurate alignment of the meshes 38 and 40 with the color selection electrode 28 unnecessary.

Figure 2:
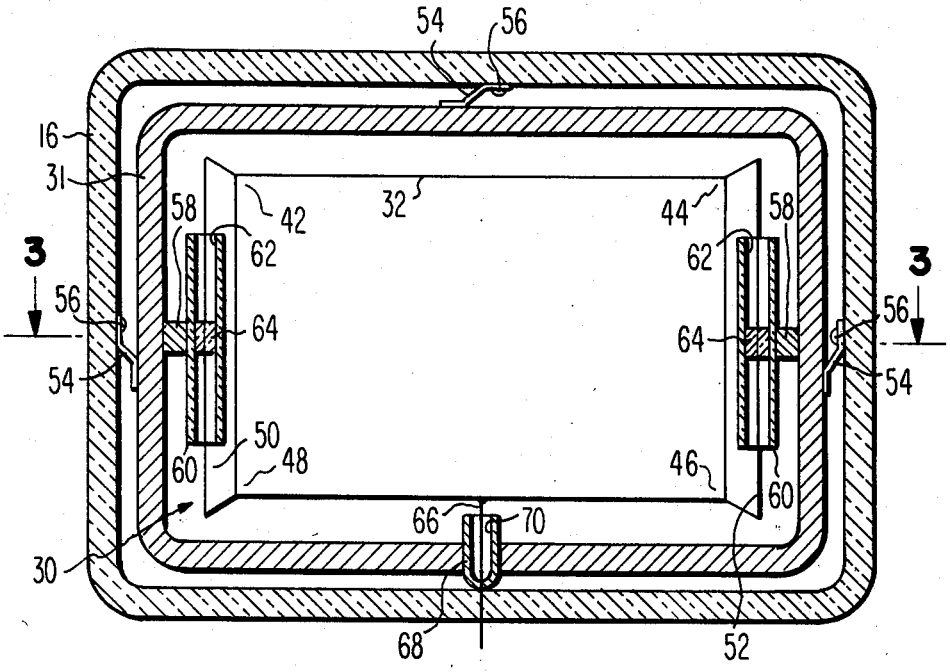
FIG. 2 is an inside view of the CRT showing support structure for a color selection electrode taken at line 2—2 of FIG. 1.
Figure 3:
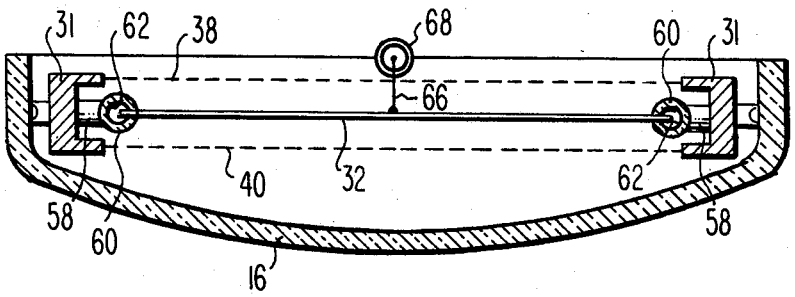
FIG. 3 is an inside view of the CRT taken at line 3—3 of FIG. 2.

FIGS. 2 and 3 show details of a support means for supporting the focus mask 24 which includes the frame means 30. The frame means 30 includes a first frame 31 and a wire second frame 32. The first frame 31 is a rectangular metal structure having a C-shaped cross-section. The wire second frame 32 has corners 42, 44, 46, and 48 at which the color selection electrode 28 (not shown in FIGS. 2 and 3) is welded. The second frame 32 also comprises end portions 50 and 52. The first frame 31 has the meshes 38 and 40 welded thereto and includes springs 54 on three sides that engage studs 56 disposed on the inside of the faceplate panel 16. The studs 56 have an aquadag conducting layer (not shown)

on their outside surface to connect to a similar coating on the funnel 17 of the CRT 10. This layer conveys a high voltage to an aluminum coating (not shown) on the back of the phosphor layer 26, as is conventional. Thus the layer 26 and the meshes 38 and 40 are electrically connected. A pair of outside supports 58, such as metal straps, are welded to the first frame 31 and respectively support insulating support elements, such as hollow cylindrical glass tubes 60, having interior surfaces 62. The tubes 60 are about 8 inches (203.2 mm) long, have an inside diameter of about 0.25 inch (6.35 mm) and lie in the plane of the color selection electrode 28. Cylindrical inside insulating glass supports 64 are respectively disposed within and at the centers of the tubes 60 and have an outside diameter equal to the inside diameter of the tubes 60. The supports 64 receive the respective centers of the end portions 50 and 52 of the second frame 32 in central axial holes thereof.

In order to apply a voltage to the color selection electrode 28, a lead-in or feed through wire 66 is attached to the bottom of the wire second frame 32. The wire 66 is bent at a right angle to form horizontal and vertical portions (as shown in FIGS. 2 and 3 taken together) and has an insulating glass tube 68 disposed around its vertical portion. The tube 68, which has a length of about 2 inches (50.8 mm) and an inside diameter of about 0.125 inch (3.175 mm) and lies in the plane of the color selection electrode 28, is closed at its bottom. The bottom of the tube 68 abuts the inside surface of the panel 16 and the funnel 17. The tube 68 has an interior surface 70. The vertical portion of the wire 66 extends out through a frit seal between the panel 16 and the funnel 17 to the outside of the CRT where a conventional connector cap (not shown) is attached.

In operation, the meshes 38 and 40 and the screen 21 have a high voltage, e.g. 25 KV, applied thereto. The color selection electrode 28 has a much lower voltage applied thereto to maximize the lens effect of the focus mask, therefore minimizing interception of electrons in the beam 20. In general, the color selection electrode 28 has a voltage at least equal to or greater than that of the G1 control electrode (not shown) of the electron gun 18 in order to prevent beam current interception. In a typical application where the cathode of the gun 18 has a voltage of +200 volts, and the G1 voltage is 0 volts, the minimum voltage for the color selection electrode 28 is therefore 0 volts. The maximum voltage for the color selection electrode 28 has been found to be about 2000 volts to reduce interception of electrons of the beams 20 by the color selection electrode 28 and therefore reduce secondary emission therefrom.

The foregoing mode of operation creates a large voltage difference between the color selection electrode 28 and the meshes 38 and 40. Such large voltage-differences have caused voltage breakdowns within the envelopes 12 of the prior art tubes because of deposits of the getter material. However, in the present invention, due to the large length to diameter ratios of the tubes 60 and 68 (about 16:1 for the numerical values given above and considering that the supports 64 divide the tubes 60 into two portions), it has been found that the getter material does not deposit on the interior surfaces 62 and 70 of the tubes 60 and 68 or on the inside insulating support 64. Therefore no spurious conduction paths exist on such surfaces or on the support 64. Thus the support and lead-in structure of the present invention does not break down when large voltage differences exist during normal display operation.

It will be appreciated that many other embodiments are possible within the spirit and scope of the invention. For example, the interior surfaces of the tubes 60 and 68 can be corregated to in order to provide a longer possible conduction path on the interior surfaces, and thus further minimize the possibility of breakdown.

What is claimed is:

1. In a cathode ray tube of the type including an evacuated envelope enclosing a cathodoluminescent screen at one end and an electron gun at an opposing end, a color selection electrode disposed proximate said screen on a first frame, and a pair of focusing meshes disposed on said frame on either side of said color selection electrode; wherein the improvement comprises support means for supporting said electrode on said frame, said support means including an insulating support tube having an interior surface, and a wire second frame to which said electrode is attached, said support means including an inside insulating support disposed within said tube adjacent to said interior surface such that the ends of said tube are open, and said second frame having end portions disposed in said inside insulating support.

2. A cathode ray tube as claimed in claim 1, wherein said support element comprises a hollow glass tube.

3. A cathode ray tube as claimed in claim 1, further comprising a strap for securing said support element to said frame.

4. A cathode ray tube as claimed in claim 1, wherein said electrode has a voltage of zero to 2000 volts applied thereto.

5. A cathode ray tube as claimed in claim 1, further comprising a lead-in wire coupled to said electrode and extending outside said envelope, and an insulating tube disposed around said lead-in wire and having an open end proximate said electrode and a closed end abutting said envelope.

6. In a cathode ray tube of the type including an evacuated envelope enclosing a cathodoluminescent screen at one end and an electron gun at an opposing end having a control grid electrode of a selected potential, a color selection electrode disposed proximate said screen on a frame, and a pair of focusing meshes disposed on said frame on either side of said color selection electrode; wherein the improvement comprises a lead-in wire coupled to said electrode and extending outside said envelope, and an insulating tube disposed around said lead-in wire and having an open end proximate said electrode and a closed end abutting said envelope.

7. A cathode ray tube as claimed in claim 6, wherein said lead-in wire passes between the panel and the funnel of said envelope.

* * * * *